US010051690B2

(12) United States Patent
Miura et al.

(10) Patent No.: US 10,051,690 B2
(45) Date of Patent: Aug. 14, 2018

(54) CLOTH-LIKE HEATER

(71) Applicant: NISSAN MOTOR CO., LTD., Kanagawa (JP)

(72) Inventors: Hiroaki Miura, Kanagawa (JP); Takashi Sunda, Kanagawa (JP); Yasuhiro Fukuyama, Kanagawa (JP)

(73) Assignee: NISSAN MOTOR CO., LTD., Kanagawa (JP)

( * ) Notice: Subject to any disclaimer, the term of this patent is extended or adjusted under 35 U.S.C. 154(b) by 772 days.

(21) Appl. No.: 14/363,169

(22) PCT Filed: Nov. 12, 2012

(86) PCT No.: PCT/JP2012/079278
§ 371 (c)(1),
(2) Date: Jun. 5, 2014

(87) PCT Pub. No.: WO2013/084668
PCT Pub. Date: Jun. 13, 2013

(65) Prior Publication Data

US 2014/0332522 A1 Nov. 13, 2014

(30) Foreign Application Priority Data

Dec. 9, 2011 (JP) ..... 2011-269636

(51) Int. Cl.
*H05B 3/34* (2006.01)
*D04B 1/14* (2006.01)
(Continued)

(52) U.S. Cl.
CPC ..... *H05B 3/342* (2013.01); *D01F 8/04* (2013.01); *D04B 1/14* (2013.01); *H05B 3/146* (2013.01);
(Continued)

(58) Field of Classification Search
CPC . H05B 3/34; H05B 3/146; H05B 3/12; H05B 3/023
(Continued)

(56) References Cited

U.S. PATENT DOCUMENTS 2,327,756 A * 8/1943 Adamson ..... H05B 3/342 139/421
4,845,343 A * 7/1989 Aune ..... H05B 3/146 219/529
(Continued)

FOREIGN PATENT DOCUMENTS

CN 2538902 Y 3/2003
CN 2781704 Y 5/2006
(Continued)

OTHER PUBLICATIONS

International Search Report for corresponding International Application No. PCT/JP2012/079278, dated Dec. 11, 2012 (2 pages).
(Continued)

*Primary Examiner* — David Angwin
*Assistant Examiner* — Jimmy Chou
(74) *Attorney, Agent, or Firm* — Osha Liang LLP

(57) ABSTRACT

A cloth-like heater has a first fiber layer that is sheet-shaped, and having a first surface that is perpendicular to a thickness direction of the first fiber layer, a second fiber layer that is sheet-shaped, and having a second surface that is perpendicular to a thickness direction of the second fiber layer and that faces the first surface of the first fiber layer via a space, and a third fiber layer provided between the first fiber layer and the second fiber layer. The first fiber layer has a plurality of first conducting parts that has electroconductivity and is arranged in selected sites, and a plurality of first non-conducting parts that has insulating properties and is arranged in sites other than the first conducting parts.

9 Claims, 6 Drawing Sheets

(51) Int. Cl.
*D01F 8/04* (2006.01)
*H05B 3/14* (2006.01)
*H05B 3/36* (2006.01)

(52) U.S. Cl.
CPC ..... *H05B 3/36* (2013.01); *D10B 2505/08* (2013.01); *H05B 2203/009* (2013.01); *H05B 2203/029* (2013.01); *H05B 2203/036* (2013.01)

(58) Field of Classification Search
USPC ..... 219/541, 202, 217, 522, 528, 520, 529, 219/549, 553; 313/511
See application file for complete search history.

(56) References Cited

U.S. PATENT DOCUMENTS 5,686,521 A * 11/1997 Massengale ..... C08K 7/06 524/495
5,820,788 A * 10/1998 Smith ..... H01B 1/24 252/511
6,229,123 B1 * 5/2001 Kochman ..... A41D 13/0051 219/529
6,608,438 B2 * 8/2003 Topelberg ..... H05B 33/26 313/491
7,337,810 B2 * 3/2008 Orr ..... D04H 3/05 139/408
7,560,670 B2 * 7/2009 Lorenzen ..... H05B 3/342 165/158
8,288,693 B2 * 10/2012 Weiss ..... H05B 3/342 219/528
8,371,339 B2 2/2013 Li et al.
8,394,296 B2 * 3/2013 Park ..... H01B 1/24 252/511
8,395,093 B1 * 3/2013 Auffinger, III ..... H05B 3/10 219/543
9,017,580 B2 * 4/2015 Dasgupta ..... B29C 70/025 156/242
9,127,381 B2 * 9/2015 Gao ..... H05B 3/03
2001/0014212 A1 * 8/2001 Rutherford ..... H05B 3/36 392/503
2005/0061802 A1 * 3/2005 Rock ..... D04B 1/04 219/545
2005/0067405 A1 * 3/2005 DeAngelis ..... H05B 3/34 219/549
2005/0103773 A1 * 5/2005 Diemer ..... B60N 2/5685 219/528
2005/0263519 A1 * 12/2005 Michelmann ..... H05B 3/342 219/549
2006/0151476 A1 * 7/2006 Green ..... H05B 3/347 219/545
2007/0257027 A1 * 11/2007 Krobok ..... H05B 3/34 219/549
2007/0278210 A1 * 12/2007 Weiss ..... B60N 2/5685 219/508
2008/0116190 A1 * 5/2008 Lewin ..... H05B 3/34 219/217
2008/0290080 A1 * 11/2008 Weiss ..... H05B 1/0238 219/202
2009/0029620 A1 * 1/2009 Miura ..... D01D 11/06 442/362
2010/0154918 A1 6/2010 Li et al.
2011/0290785 A1 * 12/2011 Schaeffer ..... B60N 2/5685 219/538

FOREIGN PATENT DOCUMENTS

JP 56-67189 A 6/1981
JP 59-180393 U 12/1984
JP 62-48351 B2 10/1987
JP 8-205968 A 8/1996
JP 2010-144312 A 7/2010
JP 2011-945 A 1/2011
WO WO 2011064707 A2 * 6/2011 ..... B29C 70/025

OTHER PUBLICATIONS

Written Opinion for corresponding International Application No. PCT/JP2012/079278, dated Dec. 11, 2012 (3 pages).

* cited by examiner

CLOTH-LIKE HEATER

TECHNICAL FIELD

The present invention relates to a cloth-like heater that can warm selectively a plurality of sites.

BACKGROUND ART

As a relating technology, as exemplified in FIG. 1 of Japanese Patent Application Laid-Open Publication No. 2010-144312 (Patent Literature 1), there is a cloth-like heater in which electroconductive string is incorporated into a fiber product and the fiber product is warmed as a whole by heat generated when the electroconductive string is energized. By energizing an electroconductive string 130 of an intermediate layer, it is possible to uniformly warm the whole of the surface.

SUMMARY OF INVENTION

Problems that the Invention is to Solve

When a plurality of warming sites is provided in which an electroconductive fiber is incorporated into the relating cloth-like heater and it is attempted to apply selectively a voltage to each of the warming sites to warm them in order to achieve an intended temperature distribution, it is necessary to incorporate an electroconductive fiber into the cloth as a conducting part and to electrically connect each of the warming sites and a device for applying a voltage. When the conducting part is made thin in order to broaden the area of the warming site and narrow the area of the conducting part, an electric resistance of the conducting part becomes high and the conducting part itself tends to generate heat. Therefore, sites other than the selected warming site are warmed and it is difficult to set the cloth-like heater to have an intended temperature distribution. Furthermore, if the conducting part is made thick, the area of warming sites in the cloth-like heater becomes small and warming capacity of the cloth-like heater as a whole lowers.

According to the present invention, it is possible to provide a cloth-like heater capable of warming only a selected warming site and achieving an intended temperature distribution, without lowering the warming capacity.

Solution to Problem

In the cloth-like heater of the present invention, the predominant characteristic is that, a voltage is selectively applied to a linking string of a third fiber layer that electrically connects a first conducting part provided in a first fiber layer and a second conducting part provided in a second fiber layer, and the linking string generates heat.

Effects of Invention

According to the cloth-like heater of the present invention, when a voltage is applied between a selected first conducting part provided in the first fiber layer and the second conducting part provided in the second fiber layer, since power is supplied from the first conducting part to the linking string constituting the third fiber layer that electrically connects the first conducting part and the second conducting part to generate heat, the warming site of the third fiber layer is warmed. On the other hand, in the first conducting part and the second conducting part that have sufficient width, heat generation is suppressed and, therefore, warming in sites other than the selected warming site is suppressed and it becomes possible to control the warming so that the cloth-like heater has an intended temperature distribution.

DESCRIPTION OF EMBODIMENTS

Figure 1:
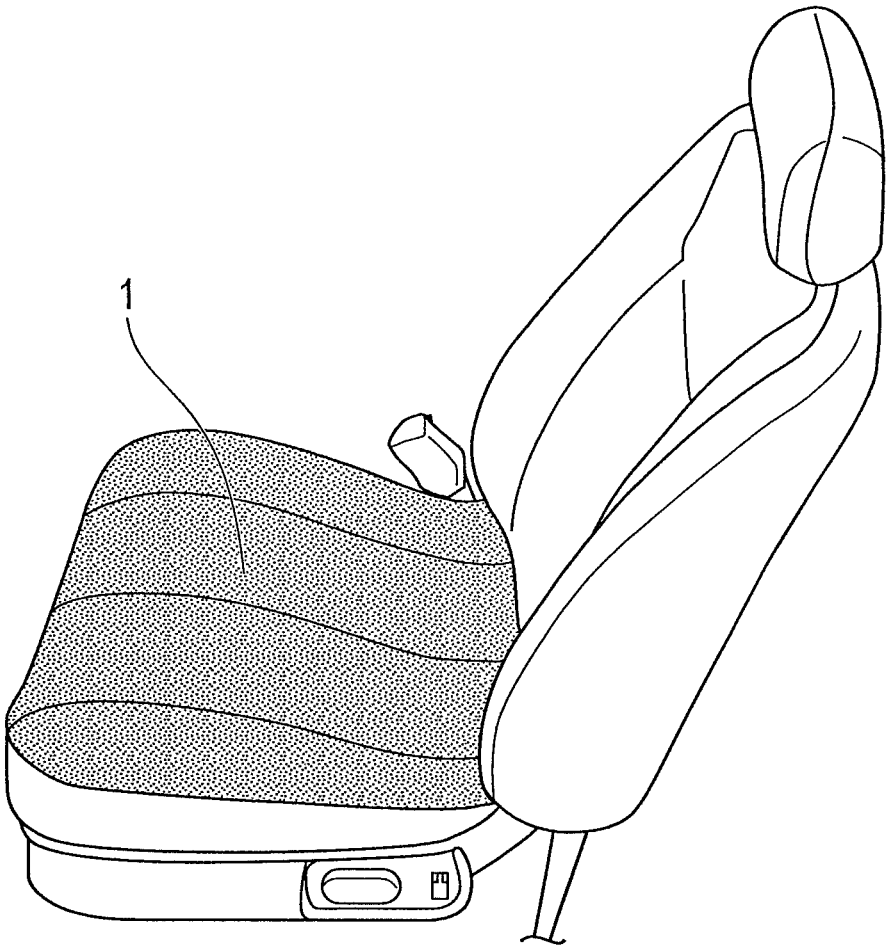
FIG. 1 is an overall view of a seat with a cloth-like heater provided in the seat surface.
Figure 2:
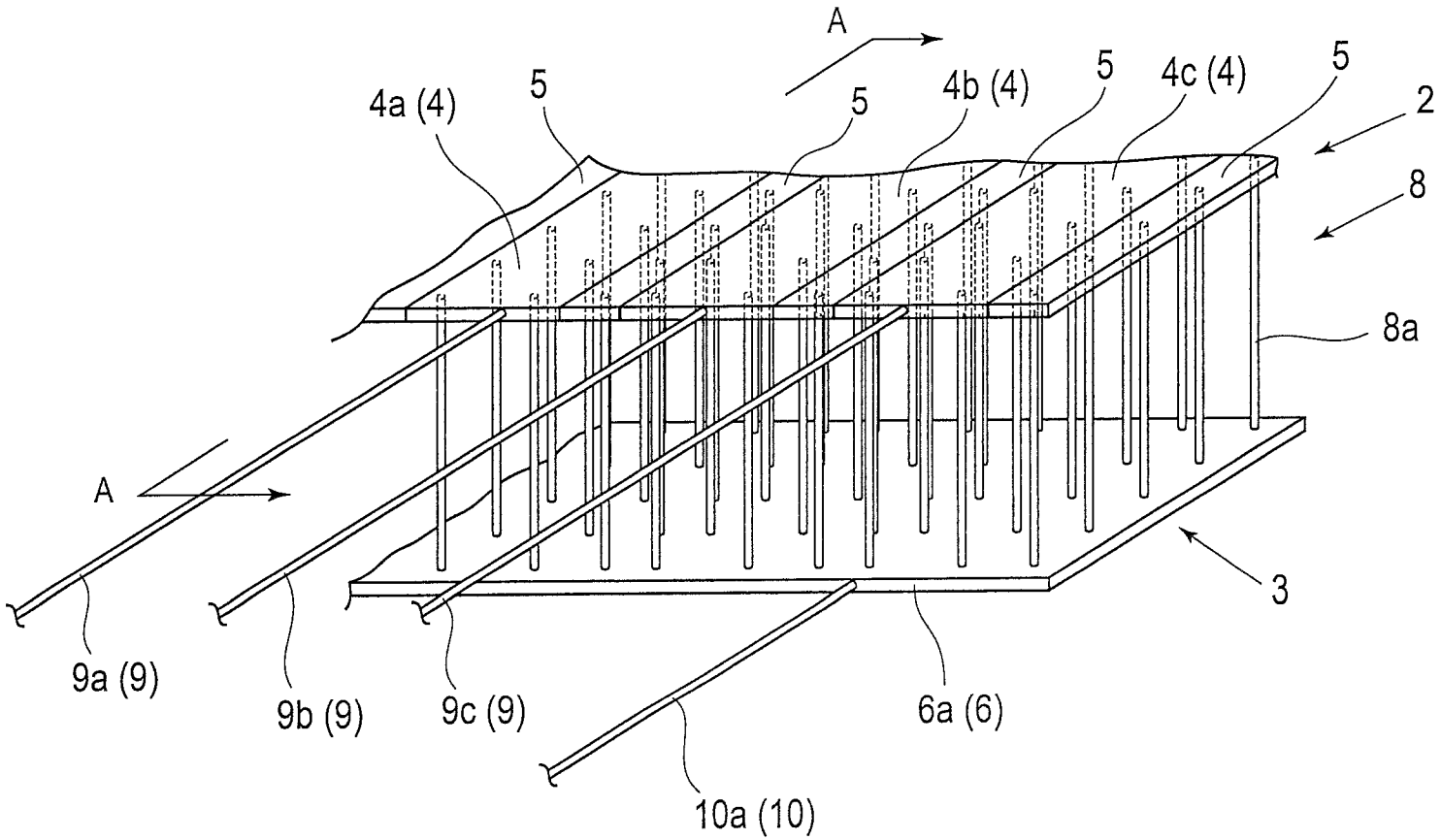
FIG. 2 is an outline view illustrating the structure of the cloth-like heater of a first embodiment.
Figure 3:
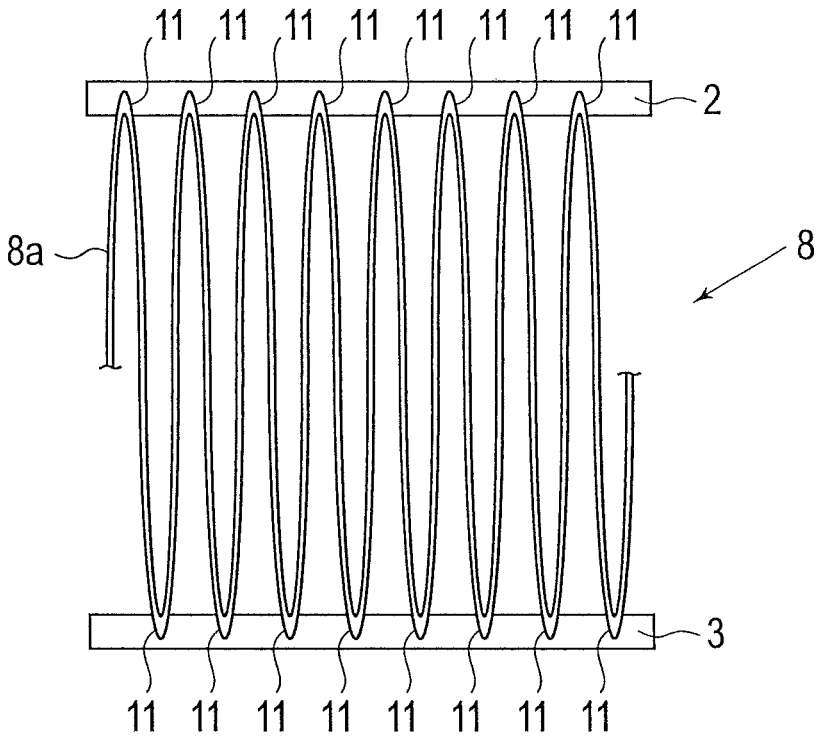
FIG. 3 is an A-A cross-sectional view in FIG. 2.

Hereinafter, embodiments will be described in detail with the drawings, by using, as an example, the case where the cloth-like heater of the present invention is used as a seat heater for a car seat. FIGS. 1 to 3 illustrate a first embodiment of the cloth-like heater according to the present invention. FIG. 1 is an overall view of a seat with the cloth-like heater provided in the seat surface, FIG. 2 is a partial outline view illustrating the structure of the cloth-like heater, and FIG. 3 illustrates an A-A cross-sectional view in FIG. 2.

A cloth-like heater 1 of the present embodiment is, as illustrated in FIG. 1, provided in the seat surface of the seat. As illustrated in FIG. 2, the cloth-like heater has a three-layer structure including an upper layer 2 (corresponding to a first fiber layer described in the claim) in which an upper layer conducting part 4 and an upper layer non-conducting part 5 are alternately provided collaterally, a lower layer 3 (corresponding to a second fiber layer described in the claim) the whole surface of which is covered with a lower layer conducting part 6, and an intermediate heat generation layer 8 (corresponding to a third fiber layer described in the claim). The upper layer 2 and the lower layer 3 are provided in positions facing each other via a space including the intermediate heat generation layer 8.

The upper layer conducting part 4 includes a plurality of upper layer conducting parts 4*a*, 4*b*, 4*c*—having a width of 10 mm and a length of 200 mm formed of a silver-coated fiber (manufactured by Shaoxing Yujia Textile Product Co., Ltd.), and, between the adjacent upper layer conducting parts 4, an upper layer non-conducting part 5 having a width of 2 mm and a length of 200 mm formed of a fiber including a polyester fiber (Gunze Polina, manufactured by Central fiber materials Ltd.) being a non-conductive resin is provided. The lower layer 3 includes a lower layer conducting part 6*a* in which the silver-coated fiber (manufactured by Shaoxing Yujia Textile Product Co., Ltd.) is braided in the whole surface.

As illustrated in FIG. 3, the intermediate heat generation layer 8 is formed by causing a linking string 8*a* to go back and forth continuously between the upper layer 2 and the lower layer 3 so as to stitch these and links the upper layer 2 to the lower layer 3. The linking string 8*a* is an electroconductive polymer fiber having a diameter of about 10 μm and obtained by a wet spinning method, which is produced by extruding a spinning dope prepared by mixing a water dispersion of an electroconductive polymer PEDOT/PSS (Clevios RP, manufactured by Starck) once filtrated using acetone (019-00353, manufactured by WAKO-Chemicals) as a solvent phase with a 7% by weight aqueous solution of polyvinyl alcohol (PVA, manufactured by KANTO KAGAKU) from a micro syringe (MS-GLL100, syringe internal diameter of 260 μm, manufactured by ITO CORPORATION) at a rate of 2 μL/min. As the result of measuring the electric conductivity of the electroconductive polymer fiber in conformity to JIS K 7194 (Testing method for resistivity of conductive plastics with a four-point probe array), the electric resistivity [Ω·cm] was in the order of $10^{-1}$ Ω·cm.

Using a circular knitting machine manufactured by Precision Fukuhara Works, Ltd., gauge, number of feeds etc. were adjusted so that the thickness of the intermediate heat generation layer between the upper and lower layers became 10 mm and the total area of the cross-section of the electroconductive polymer fiber per unit area of the plane of the intermediate heat generation layer 8 horizontal to the upper layer 2 became 50%. To the upper layer conducting part 4*a* of the upper layer 2, an upper layer electric wire 9*a* is connected electrically, to the upper layer conducting part 4*b*, an upper layer electric wire 9*b* is connected electrically, and, to the upper layer conducting part 4*c*, an upper layer electric wire 9*c* is connected electrically. To the lower layer conducting part 6 of the lower layer 3, a lower layer electric wire 10*a* is connected electrically, and each of the upper layer electric wire 9 and the electric wire 10 is connected with a controller (corresponding to a controller described in the claim) not illustrated.

As a representative, the case where the linking string 8*a* connected to the upper layer conducting part 4*a* is caused to generate heat is explained. When a prescribed voltage is applied between the upper layer electric wire 9*a* and the lower layer electric wire 10*a* by the controller, the linking string 8*a* generates heat because it has a high electric resistivity. As the result of evaluating temperature caused by heat generation under conditions of temperature at 25° C. and humidity of 60% RH in a constant-temperature bath while setting the applying voltage to be 12 V, the heat generation site of the intermediate heat generation layer 8 was warmed to 40° C. On the other hand, temperatures of the upper layer conducting part 4*a* and the lower layer conducting part 6*a* were 25° C. as the power was supplied.

In the upper layer conducting part 4 and the lower layer conducting part 6 having a sufficient width, because the electric resistance does not become high, the heat generation when the voltage is applied is suppressed. Therefore, the warming of sites other than the selected warming site can be suppressed, and it becomes possible to control the warming so that the cloth-like heater 1 has an intended temperature distribution.

Figure 4:
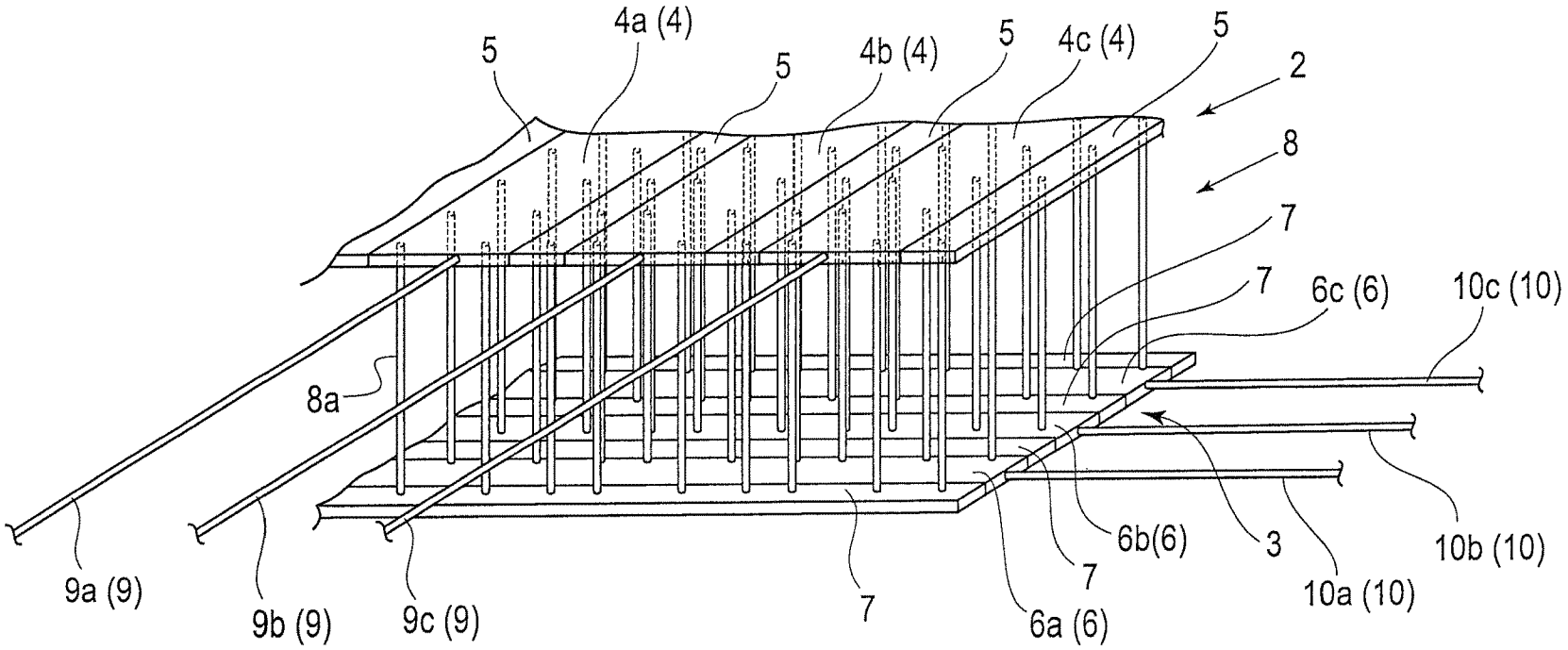
FIG. 4 is an outline view illustrating the structure of the cloth-like heater of a second embodiment.

FIG. 4 illustrates a second embodiment of the present invention, in which the same reference sign is given to the same component part as that in the first embodiment and a repeated explanation shall be omitted. As illustrated in FIG. 4, the cloth-like heater has a three-layer structure including the upper layer 2 in which the upper layer conducting part 4 and the upper layer non-conducting part 5 are alternately provided collaterally, the lower layer 3 in which the lower layer conducting part 6 and the lower layer non-conducting part 7 are alternately provided collaterally, and the intermediate heat generation layer 8 formed by causing the linking string to go back and forth continuously so as to stitch the upper layer 2 and the lower layer 3.

The upper layer 2, the upper layer conducting part 4 and the upper layer non-conducting part are the same as those in the first embodiment. The lower layer 3 is formed of a polyester fiber, the lower layer conducting part 6 includes a plurality of lower layer conducting parts 6*a*, 6*b*, 6*c*—having a width of 200 mm and a length of 10 mm formed while coating an electroconductive paste (DOTITE, manufactured by Fujikura Kasei Co., Ltd.) on the lower layer 3, and the lower layer non-conducting part 7 denotes a part having a width of 200 mm and a length of 2 mm in which the electroconductive paste is not coated.

The lower layer conducting part 6 is electrically connected to all the upper layer conducting parts 4 with the linking string 8*a*, and, when seen from the upper side of the seat, the side of the upper layer conducting part 4 along the longitudinal direction and the side of the lower layer conducting part 6 along the longitudinal direction are arranged so as to intersect each other. Typically, the upper layer conducting part 4 and the lower layer conducting part 6 are arranged so that the longitudinal directions thereof are orthogonal to each other.

To the lower layer conducting part 6*a*, the lower layer electric wire 10*a* is connected electrically, to the lower layer conducting part 6*b*, the lower layer electric wire 10*b* is connected electrically, and, to the lower layer conducting part 6*c*, the lower layer electric wire 10*c* is connected electrically. Each of the upper layer electric wire 9 and the electric wire 10 is connected with a controller (corresponding to a controller described in the claim) not illustrated.

As a representative, the case where the linking string 8*a* connected to the upper layer conducting part 4*a* and the lower layer conducting part 6*a* is caused to generate heat is explained. When a prescribed voltage is applied between the upper layer electric wire 9*a* and the lower layer electric wire 10*a* by the controller, the linking string 8*a* generates heat because it has a high electric resistivity. As the result of evaluating temperature caused by heat generation under conditions of temperature at 25° C. and humidity of 60% RH in a constant-temperature bath while setting the applying voltage to be 12 V, the heat generation site of the intermediate heat generation layer 8 was warmed to 41° C. On the other hand, temperatures of the upper layer conducting part and the lower layer conducting part, which are not heat generation sites, were 25° C.

In the upper layer conducting part 4 and the lower layer conducting part 6 that have sufficient width, because the electric resistivity does not become high, the heat generation when a voltage is applied is suppressed. Therefore, warming in sites other than the selected warming site can be controlled, and it becomes possible to control the warming so that the cloth-like heater 1 has an intended temperature distribution.

As a third embodiment of the present invention, as the electroconductive polymer fiber used for the linking string 8*a* in the first embodiment, an electroconductive polymer fiber, which was formed by coating a PVA solution prepared by dispersing carbon black (manufactured by Mitsubishi Chemical Corporation) in 20% by weight on a polyester fiber so as to give 50:50 in the cross-sectional area ratio, was used. The electric resistivity was 100 Ω·cm to give the same effect as that in the first embodiment, and the heat generation site of the intermediate heat generation layer 8 was warmed to 38° C. On the other hand, temperatures of the upper layer conducting part and the lower layer conducting part, which are not the heat generation sites, were 25° C.

As a fourth embodiment of the present invention, as the electroconductive. polymer fiber used for the linking string 8*a* in the first embodiment, a silver-coated fiber was used. The electric resistivity was 0.01 Ω·cm to give the same effect as that in the first embodiment, and the heat generation site of the intermediate heat generation layer 8 was warmed to 42° C. On the other hand, temperatures of the upper layer conducting part and the lower layer conducting part, which are not the heat generation sites, were 25° C.

As a fifth embodiment of the present invention, as the electroconductive polymer fiber used in the first embodiment, an electroconductive polymer fiber, which was formed by coating a coating solution prepared by dispersing zinc oxide (ZnO) in PVA in 20% by weight on a polyester fiber so as to give 50:50 in the cross-sectional area ratio, was used. The electric resistivity was 10 Ω·cm to give the same effect as that in the first embodiment, and the heat generation site of the intermediate heat generation layer 8 was warmed to 39° C. On the other hand, temperatures of the upper layer conducting part and the lower layer conducting part, which are not the heat generation sites, were 25° C.

As a sixth embodiment of the present invention, as the electroconductive polymer fiber used for the linking string 8*a* in the first embodiment, an electroconductive polymer fiber, which was formed by coating a water dispersion of PEDOT/PSS on a polyester fiber so as to give 50:50 in the cross-sectional area ratio, was used. The electric resistivity was 1 Ω·cm to give the same effect as that in the first embodiment, and the heat generation site of the intermediate heat generation layer 8 was warmed to 39° C. On the other hand, temperatures of the upper layer conducting part and the lower layer conducting part, which are not the heat generation sites, were 25° C.

As a seventh embodiment of the present invention, as the electroconductive polymer fiber used for the linking string 8*a* in the first embodiment, a fiber having a diameter of about 10 μm, which was formed by a wet spinning method using a 5% polypyrrole aqueous solution (manufactured by Aldrich) as an electroconductive polymer, was used. The electric resistivity was 1 Ω·cm to give the same effect as that in the first embodiment, and the heat generation site of the intermediate heat generation layer 8 was warmed to 38° C. On the other hand, temperatures of the upper layer conducting part and the lower layer conducting part, which are not the heat generation sites, were 25° C.

The evaluation results for the first to seventh embodiments are listed in Table 1.

TABLE 1

| | ELECTROCONDUCTIVE POLYMER FIBER OF INTERMEDIATE HEAT GENERATION LAYER | | | UPPER AND LOWER LAYERS | | | | EVALUATION RESULTS | |
|---|---|---|---|---|---|---|---|---|---|
| | | | | UPPER LAYER | | LOWER LAYER | | TEMPERATURE | TEMPERATURE |
| # | ELECTRO-CONDUCTIVE RAW MATERIAL | CROSS-SECTIONAL SHAPE OF FIBER | RESISTIVITY (Ω · cm) | ELECTRO-CONDUCTIVE RAW MATERIAL | SHAPE | ELECTRO-CONDUCTIVE RAW MATERIAL | SHAPE | OF HEAT GENERATION PART | OF CONDUCTING PART |
| EXAMPLE 1 | PEDOT/PSS | UNIFORM | 0.1 | SILVER-COATED FIBER | LATERAL STRIPE | SILVER-COATED FIBER | UNIFORM | 40° C. | 25° C. |
| EXAMPLE 2 | PEDOT/PSS | UNIFORM | 0.1 | SILVER-COATED FIBER | LATERAL STRIPE | SILVER PASTE | VERTICAL STRIPE | 41° C. | 25° C. |
| EXAMPLE 3 | CARBON BLACK | COATING | 100 | SILVER-COATED FIBER | LATERAL STRIPE | SILVER-COATED FIBER | UNIFORM | 38° C. | 25° C. |
| EXAMPLE 4 | SILVER FIBER | COATING | 0.01 | SILVER-COATED FIBER | LATERAL STRIPE | SILVER-COATED FIBER | UNIFORM | 42° C. | 25° C. |
| EXAMPLE 5 | ZnO | COATING | 10 | SILVER-COATED FIBER | LATERAL STRIPE | SILVER-COATED FIBER | UNIFORM | 39° C. | 25° C. |
| EXAMPLE 6 | PEDOT/PSS | COATING | 1 | SILVER-COATED FIBER | LATERAL STRIPE | SILVER-COATED FIBER | UNIFORM | 39° C. | 25° C. |
| EXAMPLE 7 | POLYPYRROLE | UNIFORM | 1 | SILVER-COATED FIBER | LATERAL STRIPE | SILVER-COATED FIBER | UNIFORM | 38° C. | 25° C. |
| COMPARATIVE EXAMPLE 1 | PEDOT/PSS | UNIFORM | 0.1 | (PET FIBER) | — | (PET FIBER) | — | 32° C. | 32° C. |

Incidentally, the cloth-like heater 1 of the present invention was explained while taking the embodiments as examples. It is not limited, however, to these embodiments but can employ various other embodiments in the range not deviating from the purport of the present invention. For example, it can be applied not only to a seat of a car but also to a cover of a cushion, an electric carpet, etc. As electroconductive raw materials for use in the present invention, any of wires of such metal as gold, silver, copper or nichrome, particles including a carbon-based material such as carbon or graphite or a semiconductor such as a metal or metal oxide, an electroconductive polymer such as acetylene-based one, heterocyclic 5-membered ring-based one, phenylene-based one or aniline-based one may be employed.

As examples of the carbon-based materials as electroconductive materials, in addition to those generally offered commercially such as fiber bodies made of carbon (Torayca, manufactured by Toray; Donacarbo, manufactured by Osaka Gas Chemicals Co., Ltd. etc.), carbon fibers, fibers spun with carbon powder etc. blended, etc. may also be used. On the other hand, examples of the particles used as an electroconductive material include carbon-based powder such as carbon black and Ketjenblack, carbon-based fibers, and metal fine particles such as iron and aluminum, and, furthermore, tin oxide ($SnO_2$), zinc oxide (ZnO) etc. as semi-electroconductive fine particles.

The electroconductive polymer fiber of the present invention denotes those excluding metals among the above-mentioned electroconductive raw materials. Those made of single material selected from these, those the surface of which is covered with the material by evaporation, coating or the like, those in which the material is used as the core material and the surface is covered with another material, etc. can be used. Among these, from the viewpoint of easy availability in the market, specific gravity etc., as the electroconductive raw material, the use of carbon fiber or carbon powder is desirable. Furthermore, there is no particular limitation on whether the electroconductive raw material includes only one raw material or a plurality of raw materials.

The upper layer 2 and the lower layer 3 themselves are preferably formed from fibers in order that air permeability is given, but the upper layer conducting part 4 and the lower layer conducting part 6 may be formed by coating uniformly an electroconductive paint etc. on the upper layer 2 and the lower layer 3 in a belt shape or over the whole surface. Examples of the electroconductive paints include DOTITE manufactured by Fujikura Kasei Co., Ltd., etc. From the viewpoint of avoiding an uncomfortable feeling as the cloth-like heater caused by partial variation in hardness, as the upper layer conducting part 4 and the lower layer conducting part 6, it is also possible to use a metal wire or an electroconductive fiber, for example, a twisted wire formed by twisting such metal as nickel, having approximately the same cross-sectional area as that of the fiber forming the upper layer 2, the lower layer 3 or the intermediate heat generation layer 8.

For the upper layer non-conducting part 5 and the lower layer non-conducting part 7, the use of fiber including such commodity resin as polyamide such as nylon 6 and nylon 66, polyethylene terephthalate, polyethylene terephthalate containing a copolymerization component, polybutylene terephthalate, polyacrylonitrile, etc. singly or in mixture is preferable from the viewpoint of cost and practicality. Furthermore, the shape of the upper layer 2 and the lower layer 3 brings about no particular problem, only if it forms a cloth having air permeability, but the use of a woven cloth, a nonwoven cloth, knitted goods or the like including the above-described generally used fiber is preferable from the viewpoint of fixing the intermediate heat generation layer and also from the purpose of causing to generate heat and to feel warm.

As a heat generation site controller used for causing an arbitrary site to generate heat, a switching element, a relay or the like generally used is used alone or in combination. The fiber in the present invention denotes, in addition to fiber spun by such a method as melt spinning, wet spinning or electro spinning, those having been slit, such as film cutting. As to the diameter and the width of the fiber on this occasion, one having generally around from several μm to several hundred μm per fiber is preferable from the viewpoint of easy weaving or knitting, softness as a woven cloth or knitted goods after the weaving or knitting, easy handling as texture, in forming woven goods and knitted goods.

By forming these fibers into a bundle (bundle shape) of several tens to several thousands of fibers, handling as a fiber also becomes easy. On this occasion, occurrence of twisting is also allowable. Since metal is a conductor having a particularly low electric resistivity, in order to cause the intermediate heat generation layer to generate heat effectively, it becomes necessary to use an extremely thin fiber or to set the distance between the upper layer and the lower layer to be large. When a thin fiber is used, even if it is intended to cause an arbitrary site or area to generate heat, heat is generated approximately at a point and, further, the air around the metal fiber works as a heat-insulating layer. Therefore, it becomes difficult to obtain the warming effect. When setting the distance between the upper layer 2 and the lower layer 3 to be large, the softness of the metal fiber becomes a drawback, and the metal fiber alone cannot support pressure in the compression direction of the cloth to lead to the mixing of another non-electroconductive fiber. As the result, a heat-insulating layer is formed to lower the heat generation efficiency.

Those in which these electroconductive raw materials are dispersed in or coated for aforementioned materials used for general fibers, that is, polymers, those obtained by forming these themselves into fibers, etc. are called electroconductive polymer fibers. In particular, the use of an electroconductive polymer fiber using a semiconductor, an electroconductive polymer or a carbon fiber as an electroconductive raw material is suitable. The blending amount of these electroconductive raw materials in the electroconductive polymer fiber is preferably from 0.5 to 30% by volume. When the blending amount of these electroconductive raw materials is less than 0.5% by volume, since the amount of the electroconductive raw materials mixed is small, the performance is substantially not changed from that of the case where no raw material is added and only the cost increases, which is not preferable. When the blending amount is more than 30% by volume, in the case where the raw material is mixed into a matrix resin, since the viscosity of the resin to be mixed increases when it is molten, the spinning property furthermore greatly lowers and fiber formation tends to be difficult.

For these matrix resins, the use of fiber including such commodity resin as polyamide such as nylon 6 and nylon 66, polyethylene terephthalate, polyethylene terephthalate containing a copolymerization component, polybutylene terephthalate, polyacrylonitrile, etc. singly or in mixture is preferable from the viewpoint of cost and practicality. It is also preferable that these electroconductive polymer fibers are coated with another polymer.

By giving the coating to the electroconductive polymer fiber, it becomes possible to improve the strength and durability of the electroconductive polymer fiber and to cause a stable heat generation performance. The coating amount may be determined in the range not disturbing the above-mentioned performance, and preferably the coating material occupies the cross-sectional area of around from 10 to 80% relative to the cross-sectional area of the electroconductive polymer fiber, more preferably around from 20 to 50%.

Figure 6:
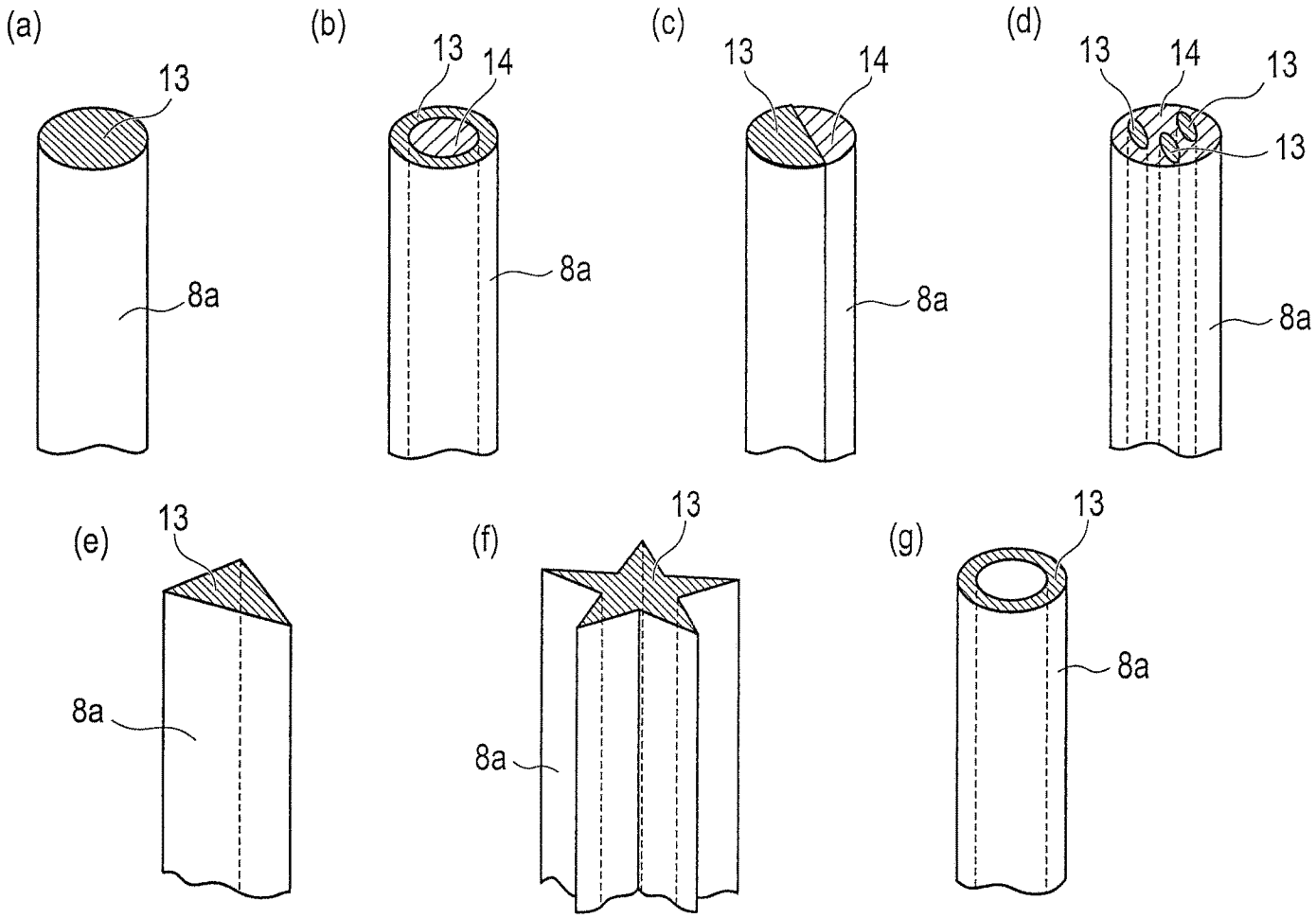
FIG. 6(*a*) is an enlarged view of an electroconductive polymer fiber made of a homogeneous material, FIG. 6(*b*) is an enlarged view of an electroconductive polymer fiber of a core-sheath structure, FIG. 6(*c*) is an enlarged view of an electroconductive polymer fiber of a side-by-side structure, FIG. 6(*d*) is an enlarged view of an electroconductive polymer fiber of a sea-island (multicore) structure, FIG. 6(*e*) is an enlarged view of an electroconductive polymer fiber with a triangular cross-section, FIG. 6(*f*) is an enlarged view of an electroconductive polymer fiber with a star-like cross-section, and FIG. 6(*g*) is an enlarged view of an electroconductive polymer fiber of a hollow structure.

As other ways for obtaining the above-mentioned performance, it is also preferable to give a cross-sectional shape of a core-sheath type, a side-by-side type, or a sea-island type formed by combining the electroconductive polymer fiber with another polymer in the step of obtaining the electroconductive polymer fiber or in the previous step of weaving or knitting after the fiber formation. In general fiber materials, as illustrated in FIGS. 6*a* to 6*g*, various structures including an electroconductive part 13 and a non-conductive part 14 can be employed. There are one formed from a homogeneous material as illustrated in FIG. 6*a*, a core-sheath structure-like one in the cross-section as illustrated in FIG. 6*b*, a side-by-side structure as illustrated in FIG. 6*c*, a sea-island (multicore) structure-like one in FIG. 6*d*, a deformed cross-sectional shape in which the cross-section is not circular as in FIGS. 6*e* and 6*f*, a hollow structure as in FIG. 6*g*, etc. These are used for changing a feeling by forming into a shape in which the fiber itself is naturally twisted, for aiming at weight saving and heat insulation by making the surface area of fiber large etc., as one way for functionalizing fibers.

The intention of the present invention is to actualize the above-mentioned function by combining the devising of a fiber structure and the devising of a material for aiming at the improvement in heat generation performance, in addition to the devising for changing these static characteristics of a fiber. Among these structures, to form into the core-sheath type is preferable. The core-sheath type referred to here denotes the case where the ratio of the core/sheath area to the cross-sectional area is nearly 50%, which can cause the function to express best when taking the balance of the strength/heat generation performances of a fiber into consideration.

As to the range of electric resistivity of an electroconductive raw material for obtaining the heat generation function mentioned above, the use of one having around from $10^{-3}$ to $10^{2}$ Ω·cm is preferable. This is because the electroconductive polymer fiber works as an electric resistance body when formed into woven goods or knitted goods and, when the resistance value is too small, the conducting part generates heat, which makes it difficult to warm an arbitrary site. On the other hand, the resistivity exceeding the range makes a current for generating heat difficult to flow, which makes it impossible to give sufficient heat generation. By setting the electric resistivity to be around from $10^{-2}$ to $\mathbf{10}^{1}$ Ω·cm as a more preferable range, it is possible to express the heat generation function more effectively.

Among the electroconductive polymer fibers that show an electric resistivity, in particular, electroconductive polymer fibers containing any of electroconductive polymers of polypyrrole and/or PEDOT/PSS and/or polyaniline and/or PPV are more preferable.

Furthermore among these, examples of materials easily obtainable as a fiber include PEDOT/PSS (Clevios P (registered), manufactured by Bayer) in which poly(4-styrenesulfonate) (PSS) is doped in poly(3,4-ethylenedioxythiophene) (PEDOT) being a thiophene-based electroconductive polymer, phenylene-based polyparaphenylene vinylene (PPV), pyrrole-based polypyrrole, etc.

Among the electroconductive polymers, these materials are preferable as materials that can easily be formed into a fiber by such a method as wet spinning or electrospinning and satisfy the electro resistivity mentioned above. For example, in the case of thiophene-based, pyrrole-based and aniline-based polymers, manufacturing by wet spinning is possible. For example, by extruding a water dispersion liquid of PEDOT/PSS (Clevios PR by Bayer) from a cylinder into acetone, it is possible to easily obtain the electroconductive polymer fiber.

Figure 5:
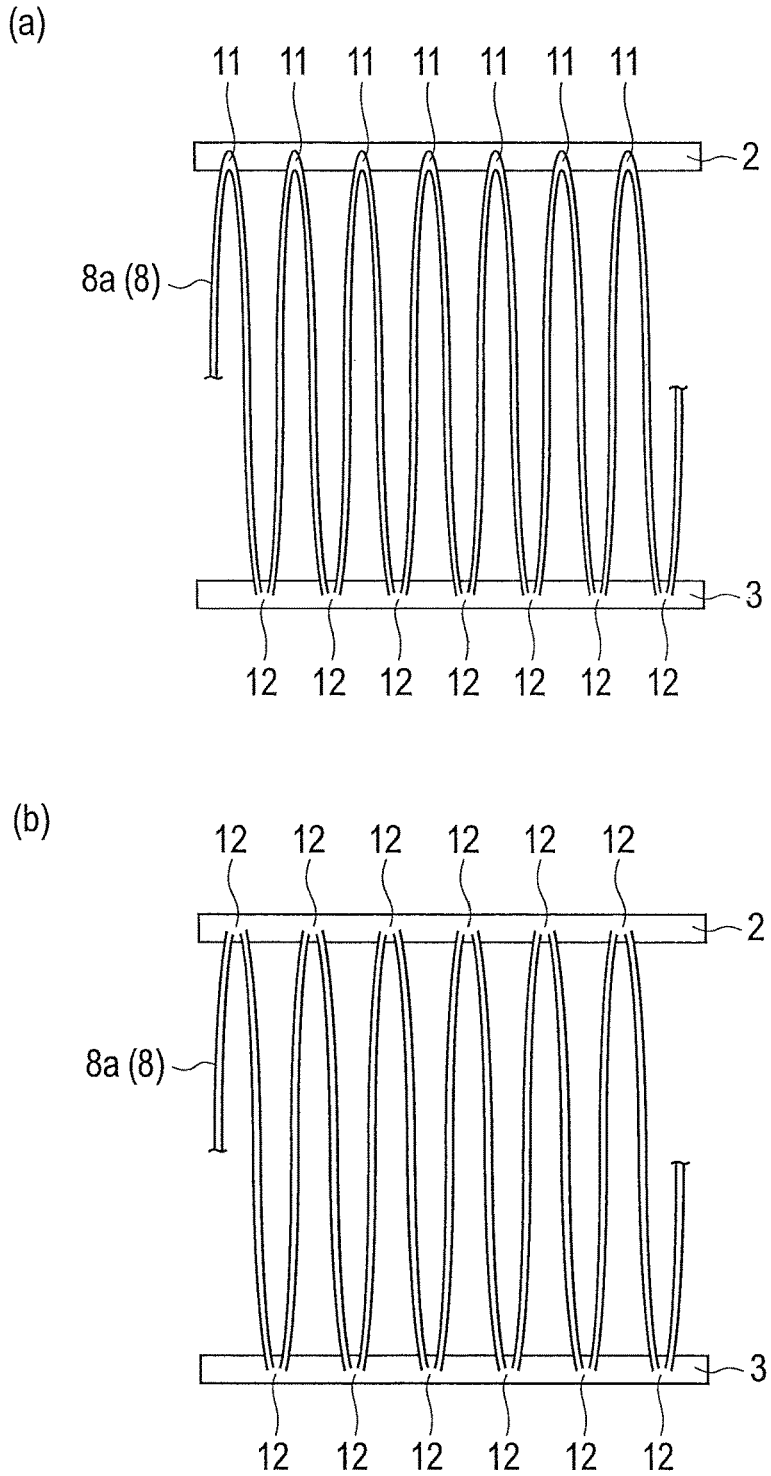
FIG. 5(*a*) is another form 1 of a linking string, and FIG. 5(*b*) is another form 2 of the linking string.

By adopting such a process, it is possible to easily manufacture the electroconductive polymer fiber for forming the cloth-like heater. In the present invention, the linking string 8*a* is not necessarily linked in one string at a linking part 11, but, as illustrated in FIGS. 5(*a*) and 5(*b*), the linking string 8*a* may have been disconnected in either of the upper layer 2 and the lower layer 3, or in both of the upper layer 2 and the lower layer 3. However, a disconnected end part 12 is necessarily fixed to the upper layer 2 or the lower layer 3 by some sort of mechanism.

(United States Designation)

In connection with United States designation, the present international patent application claims the benefit of priority under 35 U.S.C. 119(a) to Japanese Patent Application No. 2011-269636 filed on Dec. 9, 2011 whose disclosed contents are cited herein.

The invention claimed is:

1. A cloth-like heater, comprising:

a first fiber layer that is sheet-shaped, and comprising a first surface that is perpendicular to a thickness direction of the first fiber layer;

a second fiber layer that is sheet-shaped, and comprising a second surface that is perpendicular to a thickness direction of the second fiber layer and that faces the first surface of the first fiber layer via a space; and a third fiber layer provided between the first fiber layer and the second fiber layer, wherein the first fiber layer has a plurality of first conducting parts that has electroconductivity and is arranged in selected sites, and a plurality of first non-conducting parts that has insulating properties and is arranged in sites other than the first conducting parts, wherein the second fiber layer has at least one second conducting part that has electroconductivity and is arranged in a selected site, and a plurality of second non-conducting parts that has insulating properties and is arranged in sites other than the at least one second conducting part, wherein the third fiber layer has a linking string that links the plurality of first conducting parts to the at least one second conducting part to electrically connect the first fiber layer and the second fiber layer with a prescribed electric resistivity, wherein a voltage is applied between the plurality of first conducting parts having been selected and the at least one second conducting part to cause the linking string to generate heat, and wherein being sheet-shaped requires a thickness less than both length and width.

2. The cloth-like heater according to claim 1, wherein the plurality of first conducting parts has a belt-like shape, and the at least one second conducting part has a belt-like shape and is arranged in a direction intersecting the plurality of first conducting parts.

3. The cloth-like heater according to claim 1, wherein the linking string includes an electroconductive polymer fiber.

4. The cloth-like heater according to claim 3, wherein the linking string is an electroconductive polymer fiber including a semiconductor.

5. The cloth-like heater according to claim 3, wherein the linking string is an electroconductive polymer fiber containing an electroconductive polymer.

6. The cloth-like heater according to claim 3, wherein the linking string is an electroconductive polymer fiber containing carbon.

7. The cloth-like heater according to claim 3, wherein the linking string is an electroconductive polymer fiber having another polymer coated on a surface of a fiber serving as a core and having electroconductivity.

8. The cloth-like heater according to claim 3, wherein the linking string is an electroconductive polymer fiber having a conductor coated on a surface of a fiber serving as a core.

9. The cloth-like heater according to claim 3, wherein an electric resistivity of the electroconductive polymer fiber is from $10^{-3}$ to $10^{2}$ Ω·cm.

* * * * *